US006702555B2

(12) United States Patent
Allen et al.

(10) Patent No.: US 6,702,555 B2
(45) Date of Patent: Mar. 9, 2004

(54) FLUID PUMP HAVING AN ISOLATED STATOR ASSEMBLY

(75) Inventors: David J. Allen, Escanaba, MI (US); Mark Bader, Gladstone, MI (US); Jeremy S. Carlson, Gladstone, MI (US); Kenneth A. DeGrave, Wilson, MI (US); Michael P. Lasecki, Gladstone, MI (US); Steven Shiverski, Perronville, MI (US)

(73) Assignee: Engineered Machined Products, Inc., Escanaba, MI (US)

( * ) Notice: Subject to any disclaimer, the term of this patent is extended or adjusted under 35 U.S.C. 154(b) by 0 days.

(21) Appl. No.: 10/198,687

(22) Filed: Jul. 17, 2002

(65) Prior Publication Data

US 2004/0013547 A1 Jan. 22, 2004

(51) Int. Cl.[7] ..... F04B 35/04

(52) U.S. Cl. ..... 417/423.1; 417/423.7; 417/423.12; 417/423.14

(58) Field of Search ..... 417/353, 423.7, 417/423.12, 423.14, 423.1

(56) References Cited

U.S. PATENT DOCUMENTS 1,974,183 A * 9/1934 Gunderson ..... 417/357
4,382,199 A * 5/1983 Isaacson ..... 310/87
5,079,488 A 1/1992 Harms et al.
5,096,390 A 3/1992 Sevrain et al.
5,474,429 A 12/1995 Heidelberg et al.
5,494,413 A 2/1996 Campen et al.
5,494,418 A * 2/1996 Moriya et al. ..... 417/423.14
5,785,013 A * 7/1998 Sinn et al. ..... 123/41.44
5,810,568 A 9/1998 Whitefield et al.
6,000,915 A 12/1999 Hartman
6,012,909 A 1/2000 Sloteman et al.
6,030,187 A 2/2000 Whitefield et al.
6,056,518 A 5/2000 Allen et al.
6,129,524 A 10/2000 Woollenweber et al.
6,445,098 B1 * 9/2002 Materne ..... 310/89
6,488,475 B2 * 12/2002 Murata et al. ..... 417/32
6,541,884 B1 * 4/2003 Croci ..... 310/87

* cited by examiner

*Primary Examiner*—Charles G. Freay
(74) *Attorney, Agent, or Firm*—Brooks Kushman P.C.

(57) ABSTRACT

A fluid pump includes a pump housing having a housing cavity with an inlet and an outlet. A diffuser is located within the housing cavity, and includes a portion that is attached to the housing. The diffuser has a diffuser cavity, in which a stator assembly and canister are located. The canister provides a seal where it contacts the diffuser; this isolates the stator assembly from the fluid. The stator assembly provides a magnetic field which drives a rotor assembly. The rotor assembly rotates an impeller, which pumps the fluid from the inlet to the outlet.

24 Claims, 5 Drawing Sheets

FLUID PUMP HAVING AN ISOLATED STATOR ASSEMBLY

BACKGROUND OF THE INVENTION

1. Field of the Invention

The present invention relates to an electronic fluid pump.

2. Background Art

Use of fluid pumps in vehicle engine cooling systems and various industrial applications is well known. However, typical fluid pumps in both of these areas have inherent limitations. Typically in engine cooling systems, a coolant pump has a pulley keyed to a shaft. The shaft is driven by the engine via a belt and pulley coupling, and rotates an impeller to pump the working fluid. Fluid seals sometimes fail due to the side load from the drive belt, which tends to allow fluid to leak past the seal into the bearing.

U.S. Pat. No. 6,056,518, issued to Allen et al. on May 2, 2000, describes one attempt to overcome the shortcomings of prior art vehicle coolant pumps. The '518 patent provides a fluid pump with a switched reluctance motor that is secured to a housing and rotates an impeller for pumping the fluid. This design eliminates the side load problem associated with keyed pulleys, but it is generally not intended for use where larger industrial pumps are required.

Industrial pumps are typically driven by an electric motor connected to the pump via a coupling, the alignment of which is critical. Misalignment of the coupling can result in premature pump failure, which leads to the use of expensive constant velocity couplings to overcome this problem. Moreover, industrial pump motors are typically air-cooled, relying on air from the surrounding environment. The cooling air is drawn through the motor housing leaving airborne dust and other contaminants deposited in the motor components. These deposits can contaminate the bearings, causing them to fail, or the deposits can coat the windings, shielding them from the cooling air and causing the windings to overheat and short out.

Accordingly, it is desirable to provide an improved fluid pump which overcomes the above-referenced shortcomings of prior art fluid pumps, while also providing enhanced fluid flow rate and control capability while reducing costs.

SUMMARY OF THE INVENTION

One aspect of the present invention provides an improved fluid pump with enhanced fluid flow rate and control capability that also reduces costs.

Another aspect of the invention provides a fluid pump that comprises a housing that has a housing cavity with an inlet and an outlet. A diffuser, at least a portion of which is attached to the housing, is substantially disposed within the housing cavity. The diffuser has an internal diffuser cavity, in which an electric motor stator assembly and a tubular member are located. The tubular member sealingly contacts the diffuser to isolate the stator assembly from the working fluid. An impeller is rotatably disposed near the inlet of the housing cavity. An electric motor rotor assembly is substantially and rotatably disposed within the tubular member, and it is connected to the impeller for pumping the fluid from the inlet to the outlet.

Yet another aspect of the invention provides a fluid pump that comprises a housing having a housing cavity with an inlet and an outlet. A diffuser having an internal diffuser cavity is substantially disposed within the housing cavity, and has at least a portion that is attached to the housing. An electric motor stator assembly and a tubular member are disposed within the diffuser cavity. The tubular member is in sealing contact with the diffuser; this isolates the stator assembly from the fluid. An impeller is rotatably disposed near the housing cavity inlet. A rotor having first and second sides is rotatably disposed within the tubular member, and a rotor shaft is attached to the rotor and connected to the impeller for pumping the fluid from the inlet to the outlet.

A further aspect of the invention provides a housing having a housing cavity with an inlet and an outlet. A diffuser, at least a portion of which is attached to the housing, is substantially disposed within the housing cavity. The diffuser includes an internal diffuser cavity, in which an electric motor stator assembly and a tubular member are located. The generally cylindrical tubular member forms a seal with the diffuser that isolates the stator assembly from the fluid. An impeller is rotatably disposed near the inlet of the housing cavity, and a rotor is rotatably disposed within the tubular member. The rotor has a rotor shaft that is attached to the impeller for pumping the fluid from the inlet to the outlet. The rotor shaft is supported within the tubular member by a shaft support apparatus. A circuit board assembly for controlling the pump is disposed within the diffuser cavity; it is electrically connected to the stator assembly and isolated from the fluid by the tubular member.

The above objects, features, and advantages of the present invention are readily apparent from the following detailed description of the best modes for carrying out the invention when taken in connection with the accompanying drawings.

DETAILED DESCRIPTION OF THE PREFERRED EMBODIMENT(S)

Figure 1:
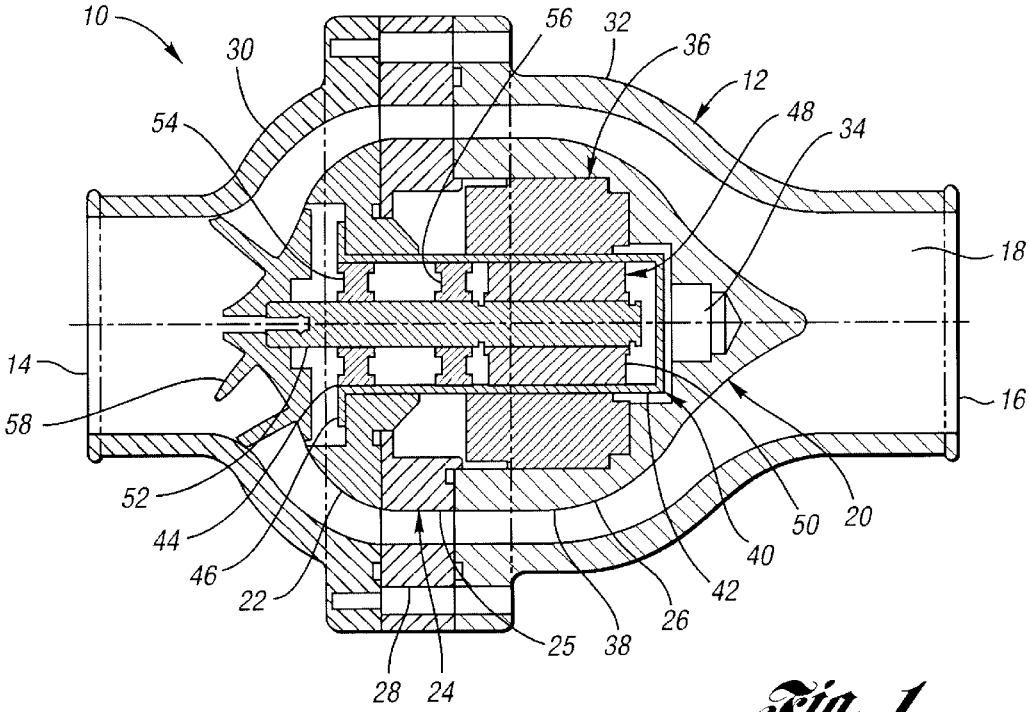
FIG. 1 is a side sectional view of a fluid pump in accordance with the present invention.

FIG. 1 shows a side sectional view of a fluid pump 10 in accordance with the present invention. The fluid pump 10 has a housing 12 that has an inlet 14 and an outlet 16. The housing 12 defines an internal housing cavity 18 in which a diffuser 20 is located. The diffuser 20 shown in FIG. 1 includes a front portion 22, a middle portion sub-assembly 24, and a back portion 26. The middle portion sub-assembly 24 of the diffuser 20 includes a vaned inner portion 25 and a diffuser ring 28. The diffuser ring 28 is shrunk-fit to the vaned inner portion 25 to create the middle portion sub-assembly 24. The diffuser ring 28 is captured between front and back pieces 30, 32 of the housing 12. Because the front and back portions 22, 26 of the diffuser 20 are connected to the middle portion sub-assembly 24, the diffuser 20 is held stationary within the housing cavity 18.

Figure 2:
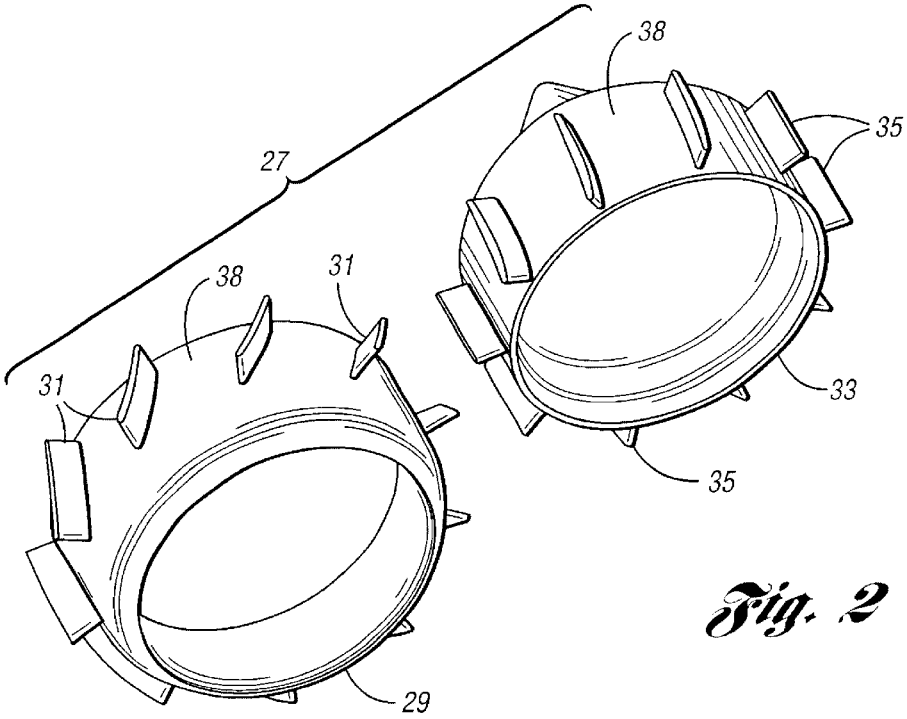
FIG. 2 is a perspective view of a two-piece diffuser that can be used in the fluid pump shown in FIG. 1.

Although the diffuser 20 is shown in FIG. 1 with a three-piece configuration, it can also be made from two pieces. FIG. 2 shows a two-piece diffuser 27, including a front portion 29 having vanes 31, and a back portion 33 having vanes 35. The diffuser ring is removed in this view to more clearly illustrate the diffuser vanes 31. The vanes 31, 35 are configured to optimize fluid flow through the pump 10, and in particular, to straighten the fluid prior its leaving the outlet 16 (see FIG. 1).

The diffuser 20 has an internal diffuser cavity 34 in which a number of the pump components are located. A stator assembly 36 is located within the diffuser cavity 34 substantially within the back portion 26 of the diffuser 20. The stator assembly 36 includes steel laminations, copper windings, and motor power leads. It is contemplated that the stator assembly 36 will be integrally molded to the back portion 26 of the diffuser 20. Molding the back portion 26 out of a thermally conductive polymer will allow good heat transfer from the stator assembly 36 to the working fluid, which will be in contact with an outer surface 38 of the diffuser 20. Also within the diffuser cavity 34 is a tubular member, which in this embodiment is a canister 40. One of the functions of the canister 40 is to form a seal with the diffuser 20 to isolate the stator assembly 36 from the working fluid.

Figure 4:
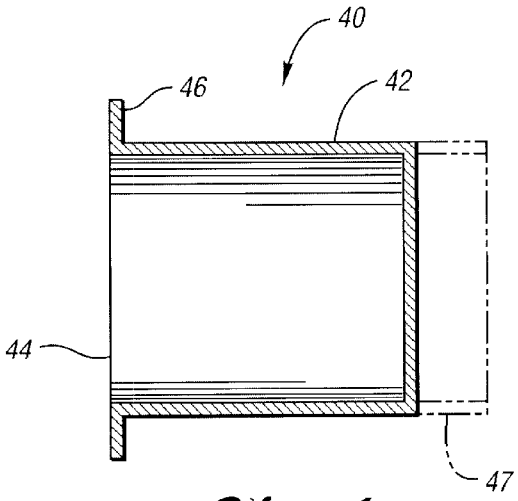
FIG. 4 is a side sectional view of a canister used to seal electrical components in the fluid pump from the working fluid.

As seen in FIGS. 1 and 4, the canister 40 has a hollow cylindrical portion 42 that has an opening 44 surrounded by a lip 46. Preferably, the canister 40 is made from a non-magnetic material and is thin so as to minimize eddy current braking losses. The canister 40 may be made from drawn stainless steel that has a wall thickness of 0.007–0.015 inches. The generally cylindrical shape of the canister 40 is well suited to the drawing process. It is understood however, that the canister 40 can be manufactured by processes other than deep drawing. In other embodiments, the canister 40 may be a tubular member open at both ends. Shown partially in phantom in FIG. 4 is a tubular member 47 having both ends open. Such a configuration requires the tubular member 47 to be sealed against the diffuser 20 at the inlet and outlet sides to ensure that the stator assembly 26 remains isolated from the working fluid.

Figure 3:
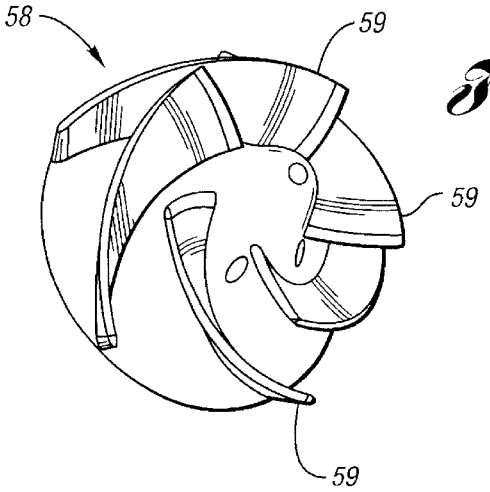
FIG. 3 is a perspective view of the impeller.

Returning to FIG. 1, it is seen that a rotor assembly 48 which includes a rotor 50 attached to a rotor shaft 52 is disposed within the canister 40. Attached to the rotor shaft 52 are bearings 54, 56 which support the rotor assembly 48. When power is provided to the pump 10, the stator assembly 36 generates a magnetic field which causes the rotor 50, and therefore the rotor shaft 52, to rotate. The rotation of the rotor shaft 52 turns an impeller 58 that is attached to one end of the rotor shaft 52. The impeller 58, shown in detail in FIG. 3, includes vanes 59 configured to pump the fluid from the inlet 14 to the outlet 16 as the impeller 58 rotates.

The stator assembly 36 and the rotor assembly 48 comprise the pump motor, which can be configured in a variety of ways to suit the requirements of different applications. For example, the rotor can be a magnet, if a brushless permanent magnet pump motor is desired. As an alternative, the pump can be driven by a switched reluctance motor, in which case the rotor 50 may be made of any ferrous metal (for example, see U.S. Pat. No. 6,056,518, describing a fluid pump using a switched reluctance motor.) Pumps using switched reluctance motors are particularly well suited to high temperature applications.

Because the pump 10 can be configured with many different types and sizes of pump motors, it can be used in a wide variety of applications. For example, when used in an automotive application, the pump motor can be powered by a low voltage DC power source. Small pumps such as this may be configured to have relatively low volumetric flow rates (40 gallons per minute (gpm) or less), with output pressures of less than two pounds per square inch (psi). Conversely, the pump 10 can be configured for a heavy-duty industrial application, in which case it may be driven by a three-phase induction motor with a high voltage AC power supply. A large industrial pump such as this can be configured to pump over 500 gpm at 25 psi.

Figure 5:
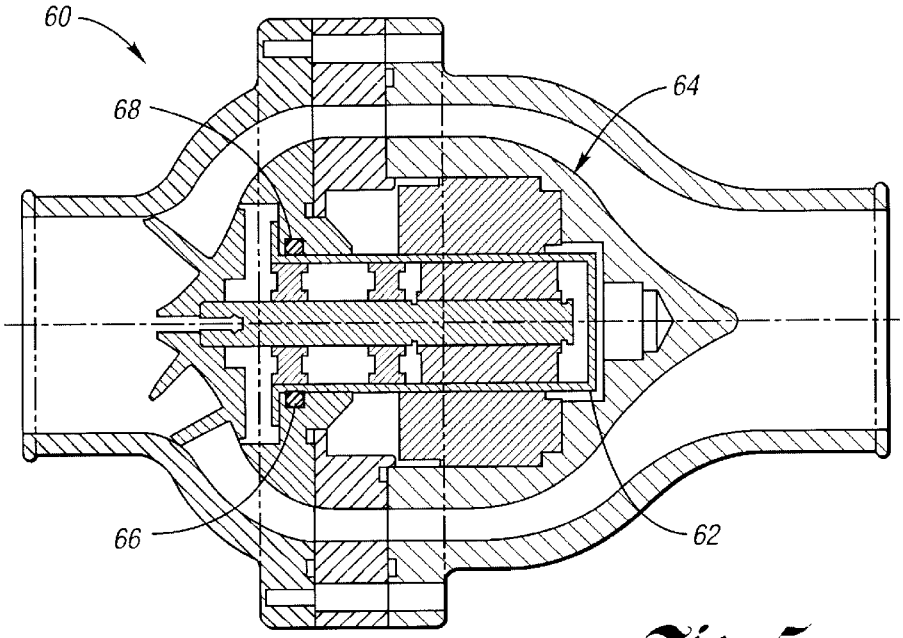
FIG. 5 is a side sectional view of a second embodiment of the fluid pump where the canister is sealed with an O-ring.

During operation of the pump 10, it is important that the working fluid does not come in contact with the stator assembly 36. This is one of the functions of the canister 40: to form a seal with the diffuser 20 so that the stator assembly 36 is isolated from the working fluid. In one embodiment, the canister 40 is attached to the diffuser 20 with an adhesive material that will also act to form a seal such that the stator assembly 36 is isolated from the working fluid. An alternative to this method is shown in FIG. 5. In FIG. 5, a fluid pump 60 is configured substantially the same as the fluid pump 10 in FIG. 1. However, the seal between the canister 62 and the diffuser 64 is accomplished not with an adhesive, but rather with an elastomeric material such as an O-ring 66 located in a groove 68 molded into the diffuser 64.

When an O-ring seal such as that shown in FIG. 5 is used to isolate a stator assembly from the working fluid, the canister may be attached to the diffuser with an adhesive, or even threaded fasteners. Moreover, it is also possible to press fit the canister into the diffuser and thereby form a secure attachment. Adhesive bonding between the canister and the diffuser is another option. The methods described herein merely represent a few of the possible ways of attaching the canister and forming a seal to isolate the stator assembly.

Returning to FIG. 1, it is clear that as the working fluid is pumped from the inlet 14 to the outlet 16, the stator assembly 36 remains isolated from the working fluid because of the seal between the canister 40 and the diffuser 20. However, the components inside the canister 40, unlike the stator assembly 36, are in constant contact with the working fluid. Thus, the bearings 54, 56 as well as the rotor shaft 52 and the rotor 50 itself contact the working fluid as it is pumped from the inlet 14 to the outlet 16. This eliminates the need for a seal at the opening 44 of the canister 40. Although the rotor 50 experiences a greater drag when it rotates in liquid rather than air, a reduction in drag realized by the elimination of a shaft seal will often more than offset the additional drag resulting from the liquid. Because the working fluid will contact the bearings 54, 56 it is contemplated that these bearings will be ceramic, so that their useful life is increased and pump down time is therefore decreased. Non-ceramic bearings may of course be used, if the needs of a particular application so dictate.

Figure 6:
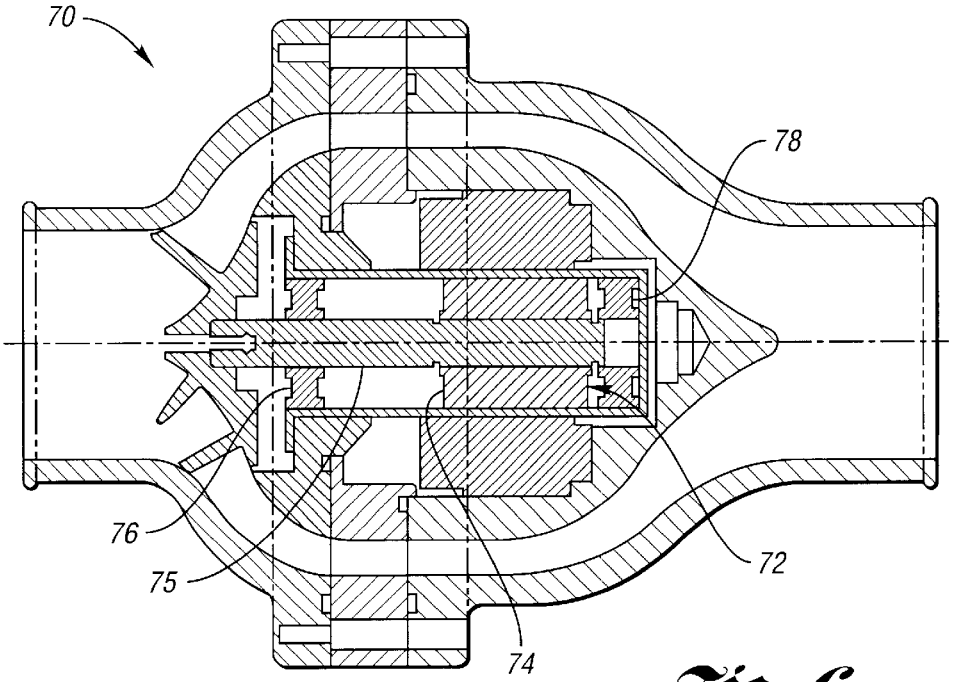
FIG. 6 is a side sectional view of a third embodiment of the fluid pump having a rotor and rotor shaft with bearings supporting the rotor shaft disposed on both sides of the rotor.

In the embodiment shown in FIG. 1, both of the bearings 54, 56 are on the inlet side of the rotor 50. This effectively cantilevers the rotor assembly 48, which makes the pump 10 robust and easy to assemble. If necessary for a particular application, bearings may be positioned such that the rotor shaft is simply supported, rather than cantilevered. For example, the fluid pump 70 shown in FIG. 6 has a rotor assembly 72 that includes a rotor 74 attached to a rotor shaft 75. In this embodiment, one bearing 76 attaches to the rotor shaft 75 on the inlet side of the rotor 74, while a second bearing 78 attaches to the rotor shaft 75 on the outlet side of the rotor 74. Thus, a rotor assembly used in the present invention may be supported in a number of ways depending on the needs of a particular application.

Figure 7:
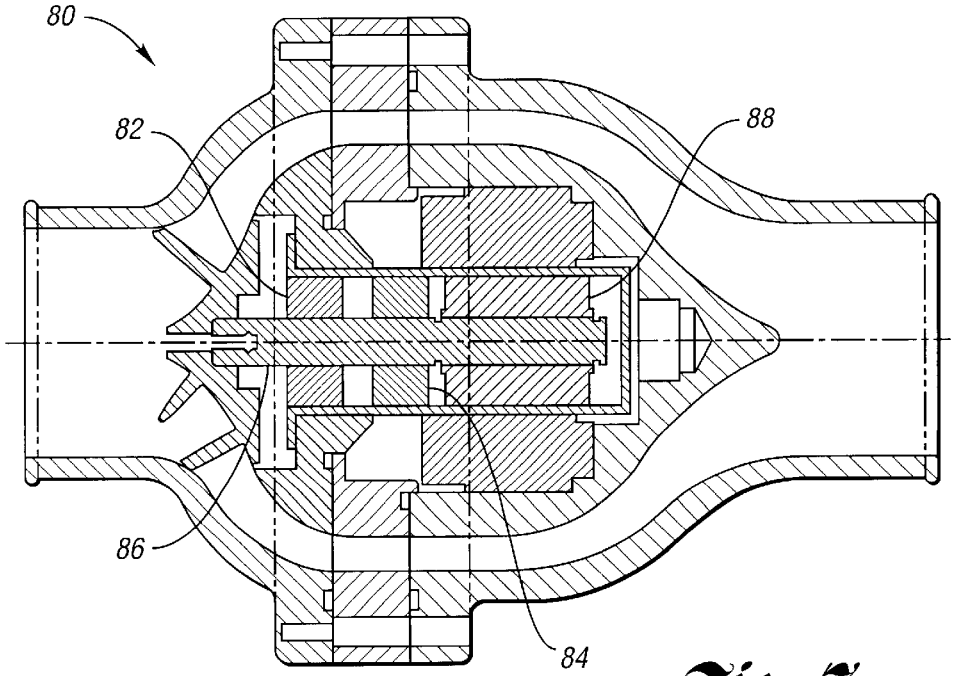
FIG. 7 is a side sectional view of a fourth embodiment of the fluid pump where the rotor shaft is supported by ceramic bushings instead of bearings.

Bearings are just one type of support apparatus that may be used to provide support for the rotor assembly. For example, bushings, and in particular ceramic bushings, provide an alternative to bearings. FIG. 7 shows a fluid pump 80 having a configuration similar to that of the pump 10 shown in FIG. 1. However, in this embodiment, the bearings 54, 56 have been replaced with ceramic bushings 82, 84. The ceramic bushings 82, 84 support a rotor shaft 86 that has attached to it a rotor 88. It is contemplated that the life of the ceramic bushings 82, 84 will exceed that of most bearings, even those that are at least partly ceramic. In addition, because the working fluid will be in almost constant contact with the bushings 82, 84 and the rotor shaft 86, the wear on the rotor shaft 86 will be minimized as the working fluid acts as a lubricant at the interface of the bushings 82, 84 and the rotor shaft 86.

Figure 8:
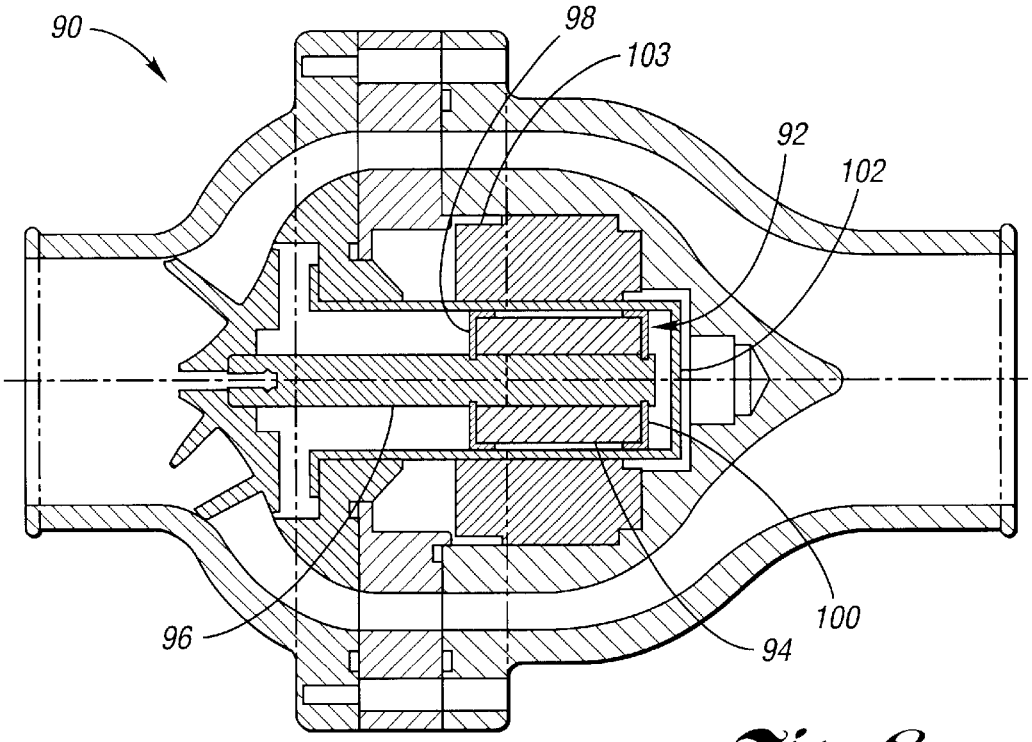
FIG. 8 is a side sectional view of a fifth embodiment of the fluid pump wherein the rotor is disposed within a ceramic bushing and the rotor shaft is not supported by bushings or bearings.

FIG. 8 shows another embodiment 90 of the present invention. Here, the fluid pump 90 has a rotor assembly 92 that includes a rotor 94 and a rotor shaft 96. In this design however, there are no bearings or bushings to support the rotor shaft 96. Rather, ceramic bushings 98, 100 keep the rotor 94 centered within a canister 102, and keep the rotor 94 from moving front to back. The bushings 98, 100 do not provide support for the rotor 94 during operation of the pump 90. Instead, the rotor 94 floats within the electromagnetic field generated by a stator assembly 103. This design eliminates losses due to friction that occur when bearings or bushings are used to support the rotor shaft. In addition, because the rotor is not actually in contact with the bushings 98, 100 while it is rotating, there is virtually no wear on the bushings 98, 100 and so their useful life is almost infinite.

Figure 9:
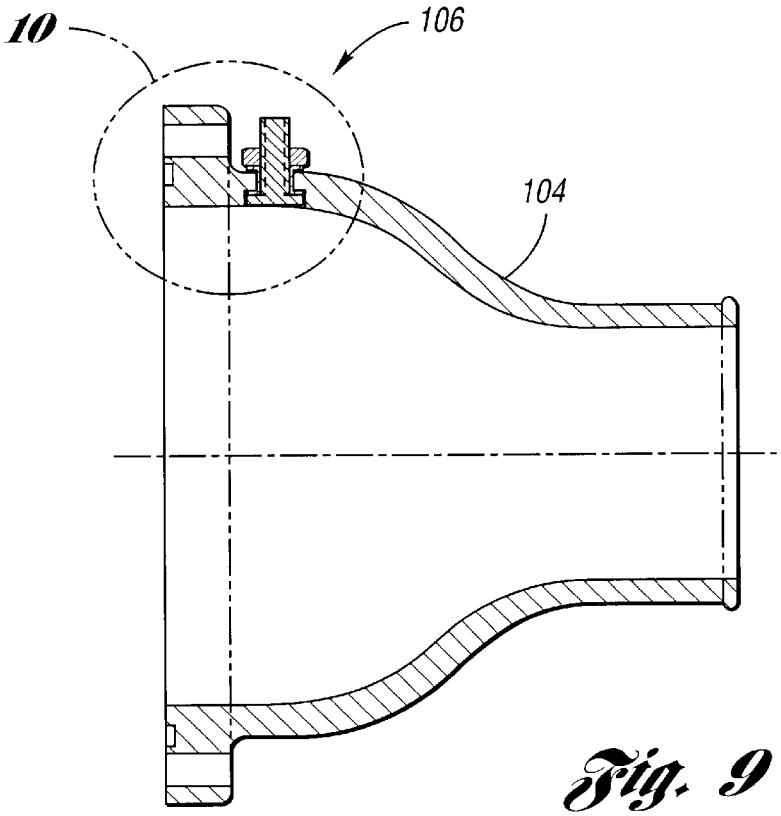
FIG. 9 is a side sectional view of a portion of a fluid pump housing having a stud terminal extending from the housing for connecting electric power and motor control circuits to the pump.

In one embodiment of the present invention such as the pump 10 shown in FIG. 1, electrical wires for both power and motor control will connect to portions of the stator assembly 36 and exit the pump housing 12 at or near the circumferential portion 28. Typically these wires will not be terminated, so as to allow for easy attachment to any kind of electrical connection required by the particular application. An alternative to having unterminated electrical wires exit the housing 12 is illustrated in FIG. 9. In FIG. 9, a portion of a pump housing 104 is shown with a threaded stud terminal 106 attached. The stud terminal 106 is shown in detail in FIG. 10. Here it is seen that the stud terminal 106 comprises a threaded stud 108 that traverses the pump housing 104 through an opening 110 in which there is placed a rubber grommet 112. A nut 114 is threaded onto the threaded stud 108 from the outside of the pump housing 104. This not only holds the threaded stud 108 in place, but also helps to seal the opening 110 so that the working fluid does not escape the housing 104. Inside the pump housing 104, the threaded stud 108 is electrically connected to a stator assembly such as 36 shown in FIG. 1. The stud terminal 106 provides a convenient method to attach the electric power and motor control circuits to the fluid pump.

Figure 10:
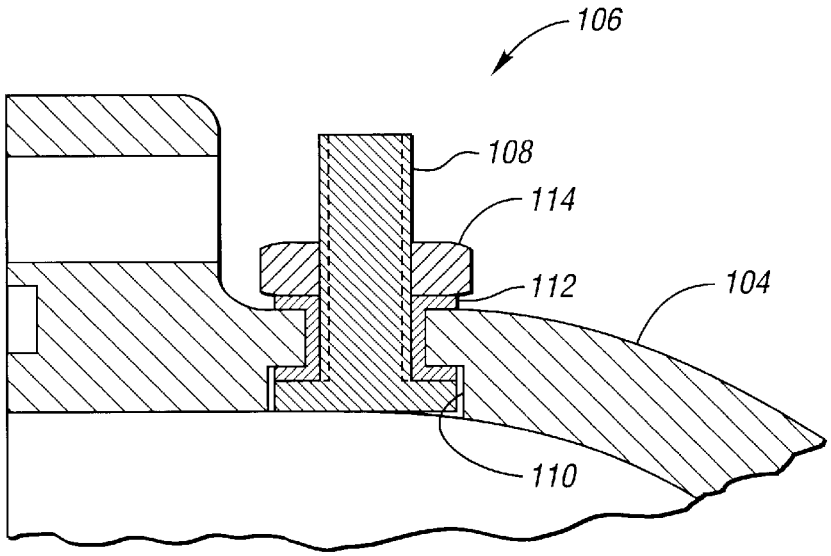
FIG. 10 is a detail view of the stud terminal shown in FIG. 9.
Figure 11:
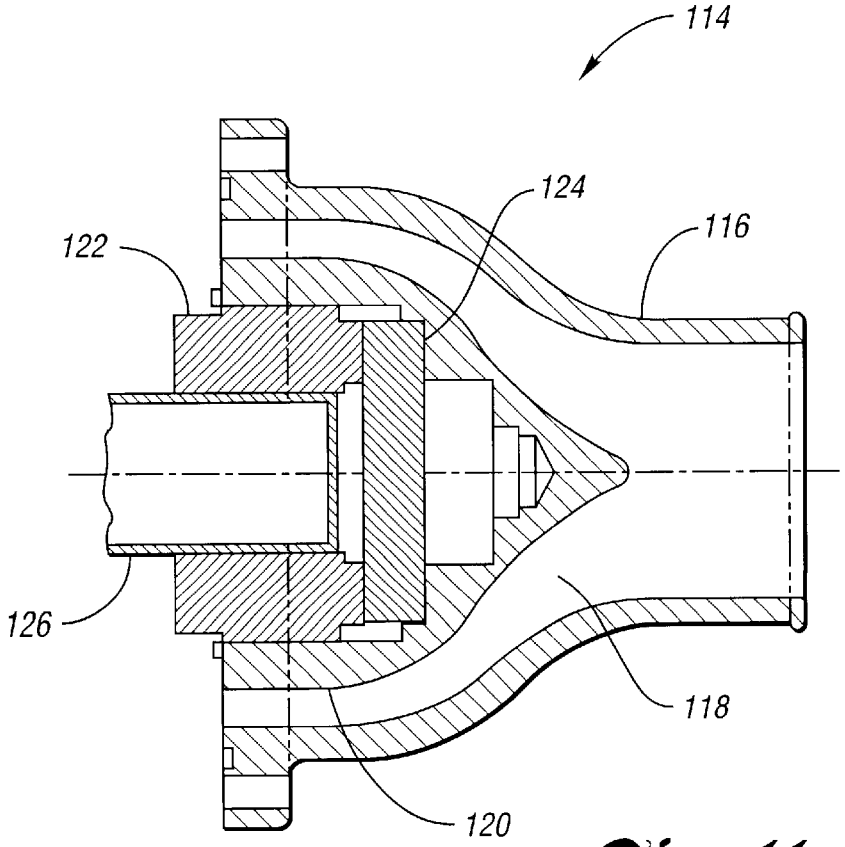
FIG. 11 is a side sectional view of a portion of a fluid pump having a controller integrated into the pump and disposed within the pump housing.

A typical fluid pump such as 10 shown in FIG. 1 will have eight wires connected to the stator assembly that either exit the pump housing with unterminated ends, or are each attached inside the pump housing to a stud terminal such as 106 shown in FIGS. 9 and 10. Of course, the number of wires connected to the stator assembly may be more or less than eight, depending on the particular application or applications for which the pump is configured. One way to reduce the number of wires leaving the pump housing or the number of stud terminals attached to the housing, is to integrate a motor controller into the fluid pump itself. Such a configuration is shown in FIG. 11. Here, a portion of a fluid pump 114 is shown with a portion of a pump housing 116 having a housing cavity 118 in which there is a portion of a diffuser 120. As in the other embodiments described above, a stator assembly 122 is attached to, or integrally molded with, a portion of the diffuser 120. In this embodiment, a controller 124 is also attached to, or integrally molded with, a portion of the diffuser 120. A canister 126 forms a seal with the diffuser 120 to isolate both the stator assembly 122 and the controller 124 from the working fluid.

This design has a number of important benefits. First, the portion of the diffuser 120 in contact with the stator assembly 122 and the controller 124 can be made from a thermally conductive polymer which allows heat transfer from both the stator assembly 122 and the controller 124 to the working fluid. Next, by locating the controller 124 inside the pump and connecting it directly to the stator assembly 122, the possibility of having problems with the motor control due to electromagnetic interference (EMI) is greatly reduced or eliminated. In addition, integrating the controller 124 into the pump reduces the number of wires or stud terminals exiting the pump housing 116, and it makes the entire pump design more compact. It is contemplated that in some applications the fluid pump of the present invention will be integrated into a system that has its own controller used to control other elements within the system. In such an application, it may be possible to configure the system controller to perform the additional task of controlling the fluid pump. Where there is not a system controller in a particular application, the integrated controller configuration shown in FIG. 11 is a convenient method for providing a fluid pump and controller in one compact package.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fluid pump, comprising:

a housing having a housing cavity therein with an inlet and an outlet;

a diffuser having an internal diffuser cavity, the diffuser substantially disposed within the housing cavity and at least a portion of which is attached to the housing;

an electric motor stator assembly substantially disposed within the diffuser cavity;

a tubular member disposed within the diffuser cavity and sealingly contacting the diffuser to isolate at least the stator assembly from the working fluid;

an impeller rotatably disposed near the inlet;

an electric motor rotor assembly substantially and rotatably disposed within the tubular member and connected to the impeller for pumping the fluid from the inlet to the outlet; and an elastomeric material disposed between the tubular member and the diffuser for providing a seal between the tubular member and the diffuser.

2. The fluid pump of claim 1, wherein the tubular member has a generally round cross-section.

3. The fluid pump of claim 2, wherein the tubular member includes a lip disposed against a portion of the diffuser.

4. The fluid pump of claim 1, wherein the rotor assembly comprises a rotor shaft and a rotor.

5. The fluid pump of claim 4, further comprising a support apparatus for supporting the rotor assembly.

6. The fluid pump of claim 5, wherein the support apparatus comprises a ceramic bushing disposed within the tubular member to support the rotor assembly.

7. The fluid pump of claim 5, wherein the support apparatus comprises first and second bearings disposed within the tubular member to support the rotor assembly.

8. The fluid pump of claim 7, wherein the first and second bearings are disposed on one side of the rotor.

9. The fluid pump of claim 7, wherein the first bearing is on one side of the rotor, and the second bearing is on another side of the rotor.

10. The fluid pump of claim 7, wherein at least a portion of the bearings comprise a ceramic material.

11. The fluid pump of claim 1, wherein the rotor assembly is supported by an electromagnetic field generated by the stator assembly.

12. The fluid pump of claim 1, further comprising a stud terminal electrically connected to the stator assembly, attached to the housing, and at least partially disposed outside the housing cavity.

13. The fluid pump of claim 1, further comprising a circuit board assembly for controlling the pump, substantially disposed within the diffuser cavity, electrically connected to the stator assembly, and isolated from the fluid by the tubular member.

14. The fluid pump of claim 13, wherein the circuit board is integrally molded into a portion of the diffuser.

15. A fluid pump, comprising:

a housing having a housing cavity therein with an inlet and an outlet;

a diffuser having an internal diffuser cavity, the diffuser substantially disposed within the housing cavity and at least a portion of which is attached to the housing;

an electric motor stator assembly substantially disposed within the diffuser cavity;

a tubular member disposed within the diffuser cavity and sealingly contacting the diffuser to isolate at least the stator assembly from the working fluid;

an impeller rotatably disposed near the inlet;

a rotor rotatably disposed within the tubular member;

a rotor shaft attached to the rotor and connected to the impeller for pumping the fluid from the inlet to the outlet;

first and second bearings for supporting the rotor shaft, each of the bearings engaging the tubular member.

16. The fluid pump of claim 15, wherein the tubular member is attached to the diffuser with an adhesive material, the adhesive material further providing a seal between the tubular member and the diffuser.

17. The fluid pump of claim 15, wherein the first and second bearings are disposed on one side of the rotor.

18. The fluid pump of claim 15, further comprising a stud terminal electrically connected to the stator assembly, attached to the housing, and at least partially disposed outside the housing cavity.

19. The fluid pump of claim 15, further comprising a circuit board assembly for controlling the pump, substantially disposed within the diffuser cavity, electrically connected to the stator assembly, and isolated from the fluid by the tubular member.

20. The fluid pump of claim 15, wherein the tubular member is press-fit into the diffuser.

21. The fluid pump of claim 15, further comprising an elastomeric material disposed between the tubular member and the diffuser for providing a seal between the tubular member and the diffuser.

22. A fluid pump, comprising:

a housing having a housing cavity therein with an inlet and an outlet;

a diffuser having an internal diffuser cavity, the diffuser substantially disposed within the housing cavity and at least a portion of which is attached to the housing;

an electric motor stator assembly substantially disposed within the diffuser cavity;

a generally cylindrical tubular member disposed within the diffuser cavity and sealingly contacting the diffuser to isolate at least the stator assembly from the working fluid;

an impeller rotatably disposed near the inlet;

a rotor rotatably disposed within the tubular member;

a rotor shaft attached to the rotor and connected to the impeller for pumping the fluid from the inlet to the outlet; and a circuit board assembly for controlling the pump, substantially disposed within the diffuser cavity, electrically connected to the stator assembly, and isolated from the fluid by the tubular member.

23. The fluid pump of claim 22, further comprising a support apparatus disposed within the tubular member for supporting the rotor shaft.

24. The fluid pump of claim 23, wherein the support apparatus comprises first and second bearings.

* * * * *